US012569720B2

(12) United States Patent
Benson et al.

(10) Patent No.: US 12,569,720 B2
(45) Date of Patent: Mar. 10, 2026

(54) DEVICE AND METHOD FOR EXERCISING AND MAINTAINING BLADDER AND BOWEL CONTROL

(71) Applicants: Michelle Benson, Acworth, GA (US); Joseph Benson, Acworth, GA (US)

(72) Inventors: Michelle Benson, Acworth, GA (US); Joseph Benson, Acworth, GA (US)

( * ) Notice: Subject to any disclaimer, the term of this patent is extended or adjusted under 35 U.S.C. 154(b) by 114 days.

(21) Appl. No.: 18/097,217

(22) Filed: Jan. 14, 2023

(65) Prior Publication Data

US 2024/0238643 A1 Jul. 18, 2024

(51) Int. Cl.
*A63B 23/20* (2006.01)

(52) U.S. Cl.
CPC ..... *A63B 23/20* (2013.01)

(58) Field of Classification Search
CPC ... A63B 23/20; A63B 21/002; A63B 21/0023; A63B 21/00047; A61F 2/0004; A61F 5/48; A61F 5/0096; A61H 1/00; A61H 19/00; A61H 19/30; A61H 19/34; A61H 19/50; A61H 23/02–04; A61H 9/00; A61H 9/0007; A61H 9/005; A47C 15/08
USPC ..... 600/38, DIG. 16; 128/883–885
See application file for complete search history.

(56) References Cited

U.S. PATENT DOCUMENTS 4,749,186 A * 6/1988 Harding-Randle .... A63B 23/20 482/148
5,762,589 A * 6/1998 Parker, Jr. ..... A63B 23/20 600/38
6,030,338 A * 2/2000 Benderev ..... A61H 19/34 128/885
6,436,029 B1 * 8/2002 Benderev ..... A61H 19/34 128/885
7,473,214 B2 * 1/2009 Schuurmans Stekhoven ..... A63B 23/20 600/587
7,717,835 B2 * 5/2010 Harding-Randle .... A63B 23/20 482/148
9,314,400 B1 * 4/2016 Dudley ..... A61H 19/30
10,925,487 B2 * 2/2021 Thomas ..... A61B 5/0002
(Continued)

OTHER PUBLICATIONS

LaHaye, Tim & Beverly / "The Act of Marriage" [advertisement for "Pelva-Tone, Kegel Exerciser and Program"]—4-pg photocopy attached.

*Primary Examiner* — Joshua T Kennedy
(74) *Attorney, Agent, or Firm* — J.T. Hollin, Attorney at Law, P.C.

(57) ABSTRACT

A bladder and bowel control training device, being a hollow, rigid, generally oblong body of uniform construction. Dimensions of length, width, and lateral curvature may be altered for facilitating use of the device by various sized persons. The bladder control device is used to provide a shaped, contoured body structure for either a male or female, to facilitate strengthening the muscles of the pelvic floor. These muscles are effectively activated by a user enveloping the outer surfaces of the bladder control device between the upper thigh muscles of both legs and flexing the thigh muscles tightly against the device. The user of the bladder control device engages the muscular exertions of the left and right adductor longus, adductor magnus, and the gracilis muscles in unison. A crescent-shaped seat segment is constructed with a non-slip gripping surface against which a user's muscles can securely flex.

9 Claims, 4 Drawing Sheets

(56) References Cited

U.S. PATENT DOCUMENTS

Figure 1:
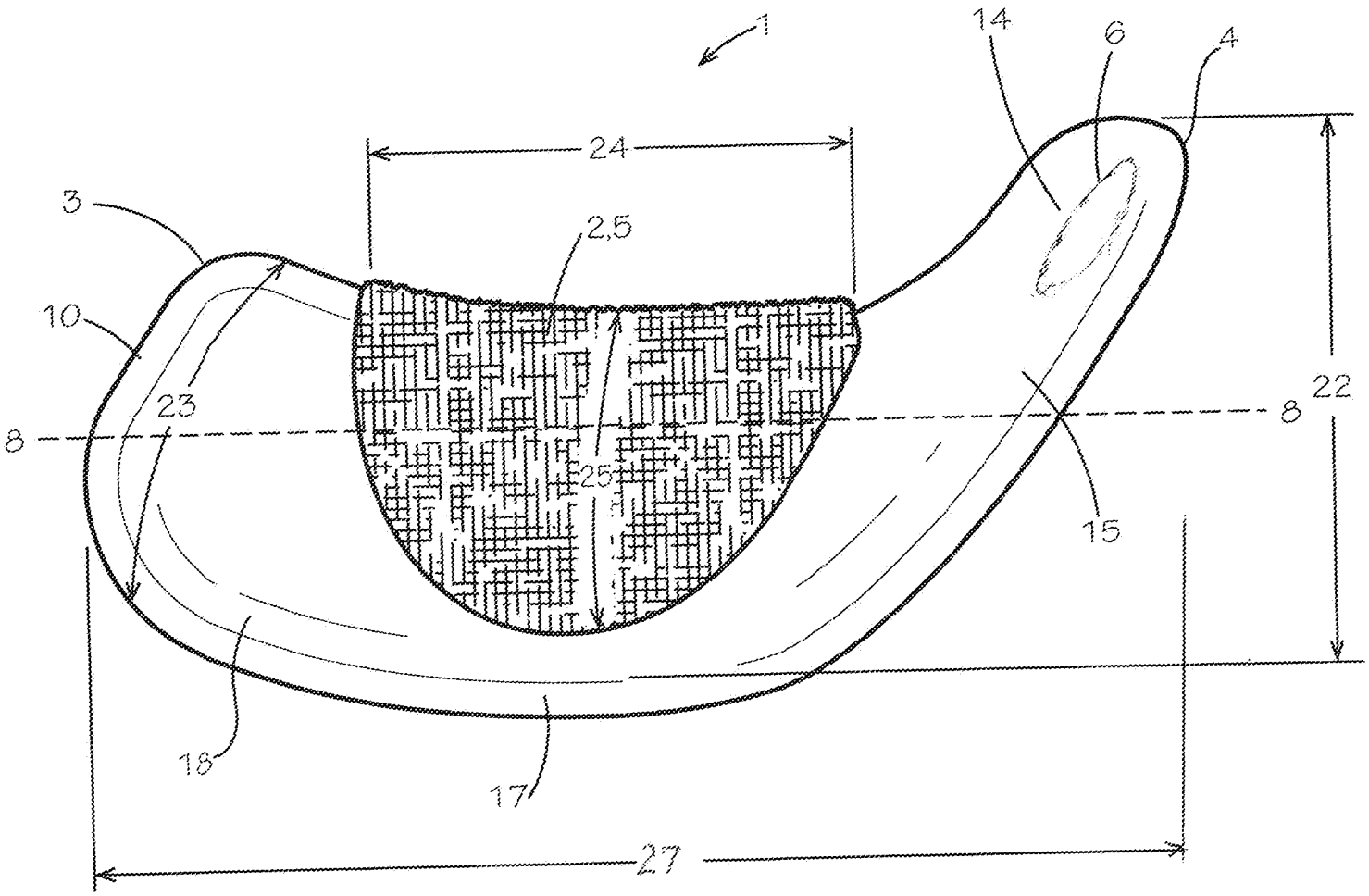

| | | | | |
|---|---|---|---|---|
| 2006/0105894 | A1* | 5/2006 | Denoth | A63B 22/16 482/148 |
| 2013/0274080 | A1* | 10/2013 | Matsushita | A47C 7/029 482/142 |
| 2015/0231437 | A1* | 8/2015 | Welsh | A63B 23/03575 482/142 |
| 2020/0384311 | A1* | 12/2020 | Zemp | A61H 7/001 |
| 2021/0077855 | A1* | 3/2021 | Walko | A61H 19/50 |
| 2023/0058145 | A1* | 2/2023 | Danielson | A63B 23/20 |
| 2023/0398403 | A1* | 12/2023 | Ito | A63B 26/003 |

* cited by examiner

DEVICE AND METHOD FOR EXERCISING AND MAINTAINING BLADDER AND BOWEL CONTROL

CROSS-REFERENCES TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION

(1) Field of the Invention

The field of the present inventive concept relates generally to methods and equipment utilized to enhance better health and hygiene for individuals with regard to either episodic bladder or bowel control issues.

Dr. Arnold H. Kegel, an American gynecologist, as early as 1948, performed research devised a technique of "Kegel exercises," which involved a method of squeezing of the muscles of the pelvic floor as a non-surgical treatment of urinary incontinence. Other prominent physicians also were cognizant of the need for an exercise product which could help persons, regardless of age, simply and easily strengthen the pelvic muscles.

While studying the physiological causes of urinary stress incontinence, Dr. Kegel discovered that the puhococcygeus or "PC" muscle, one of several muscles making up the "pelvic sling" muscle group, played a major role in bladder and bowel control, pregnancy and childbirth, and sexual satisfaction.

It is now recognized that Kegel, or pelvic floor muscle exercises, are also effective in strengthening the muscles which support the rectum. In anatomical descriptions, this specialized group of muscles is called the sphincters, this group of muscles controlling bowel continence. Kegel exercises done correctly and regularly, particularly, with respect to the disclosed inventive concept, can strengthen the sphincter muscles.

(2) Description of the Related Art, Including Information Disclosed Under 37 CFR 1.97 and 1.98

Published U.S. Patent Application #2005/0113228 A1; J. Marcotte; May 26, 2005 The Kegel exercising device and method for exercising the Kegel muscle may be employed by a female to prevent incontinence, enhance sensitivity during sexual activity and improve genital health. The Kegel exercising device has two spheres respectively for insertion into the vaginal and anal cavities, and an intermediate S-shaped portion which provides resistance against the front wall and the back wall of the Kegel muscle simultaneously. The device of the current invention thus permits a user to exercise the Kegel muscle without having to manipulate the device with her hands.

U.S. Pat. No. 11,426,625B2; Iglesias, et al; Aug. 30, 2022; A system and method for optimizing a patient's Kegel exercises is provided. The system includes a user interface device and a vaginal device. The vaginal device includes an intra-vaginal probe having an accelerometer that is configured to generate a signal in response to movement of the probe. The user interface device is connected to the vaginal device and analyzes signals from the accelerometer to provide physiological feedback information to the patient. The vaginal device may be connected to the user interface device via wireless communications.

U.S. patent Ser. No. 10/945,652B1; Wanderman, S.; Mar. 16, 2021

A Kegel exercise measurement and feedback device measures the amount of force that is exerted on a sensor portion and provides feedback in the form of vibration, a phrase or a light that is emitted from a feedback module. A sensor portion comprises a resilient body having a bladder in an inner cavity that can be compressed by Kegel exercises. Air within the bladder is forced into a bellows of the measurement portion which expands the bellows and a contactor plate attached thereto. As the contactor plate moves, due to the expansion of the bellows, it makes contact with level contactors to activate a corresponding feedback phrase, emitted light or vibration.

U.S. Published Patent Application #2022/0314068; Wang, Oct. 6, 2022

A pelvic floor muscle training device includes a pelvic floor muscle training device, an intelligent terminal, a cloud server, a VR device, and one or more application programs. The user does Kegel exercise wearing the training device, with the help of the VR device and scene induction, synergistic or independently, thus enhancing pelvic floor muscle function.

In-Tone Device: The InTone device treats bladder leakage using the most effective, non-invasive treatment strategies available. InTone combines proven technologies to strengthen your pelvic floor muscles and is designed to be used in the comfort and privacy of your home. InTone combines voice-guided pelvic floor exercises, visual biofeedback, and muscle stimulation to strengthen your pelvic floor and stop spasms of the bladder muscle. If you have a strong pelvic floor, you can do things such as cough, laugh, sneeze and run without leakage. InTone talks you through your entire 12 minute session, just as a physician would do during a clinical visit. associated medical.com/intone ApexM, a product for women, provides gentle muscle stimulation to the pelvic floor muscles to both strengthen the muscles more effectively and at the same time calms activity of the bladder. Gynecologic Specialists of Northwestern—Chicago, IL https://pelicanhealthclinic.com

BRIEF SUMMARY OF THE INVENTIVE CONCEPT

The disclosed exercise device, in general, is a bladder control device. The inventive concept herein, referred to as a "bladder device," 1 is a uniquely shaped resistance exerciser. It is constructed with specifically contoured, rounded, continuously flowing and transitioning surfaces. In the manner of weighted dumbbells that provide resistance when a user lifts them to strengthen the arms, shoulders and back muscles, the bladder control device 1 is created for the purpose of helping a person strengthen the muscles of the pelvic floor, or in physiological terminology, the pubococcygeus muscle.

The term, "pelvic sling" is often used to in reference to a broad, elastic band at the bottom of the pelvis. It supports the internal organs including the urinary tract and rectum in both sexes, along with the birth canal in women. If it sags, the organs sag with it and cause accompanying problems, notably urinary and fecal incontinence. Initial damage occurs most frequently after women experience childbirth. In the past, corrective surgery, which was not always effective, was believed to be the only alternative. The disclosed bladder control device 1 is specially designed to strengthen those muscles associated with these health problems, and can help prevent and correct such problems, without coming into contact with any internal organs of the body.

As humans age, the muscles that control elimination begin to lose their elasticity and functional capability. Consequently, many people suffer from the embarrassment and inconvenience of insufficient bladder and bowel control. By using the bladder control device 1, people will not have to resign themselves to using pads or other after-the-fact remedies. The bladder control device 1 is a hollow, generally oblong device of unitary construction having dimensions of length, width, and lateral curvature for facilitating use of the bladder control device 1.

GENERAL OBJECTIVES OF THE INVENTIVE CONCEPT

The bladder control device 1 is a hollow, crescent-shaped or oblong device of unitary construction having dimensions of length, width, and lateral curvature for facilitating use of the bladder control device 1. The primary objective of the bladder control device 1 is to provide a device and method for a person, either male or female, to strengthen the muscles of the pelvic floor, or as stated physiologically, the pubococcygeus muscle. This muscle is effectively activated by a user enveloping the outer surfaces of the bladder control device 1 between the upper thigh muscles of both legs and flexing the thigh muscles tightly against the bladder control device 1.

Another objective of the bladder control device 1, when placed in use, is to engage the muscular efforts of the left and right adductor longus, adductor magnus, and the gracilis muscle in unison. When the bladder control device 1 is placed between the upper thighs of a user, the saddle 5 of the bladder control device 1 provides a non-slip gripping surface against which these muscles can flex. Depending on the exercise routine prescribed for the user, certain time intervals are adhered to in order to establish a regularity in contracting and releasing these muscles against the surfaces of the bladder control device 1. It is a further objective of this inventive concept is to provide a method for performing what are referred to as "Kegel exercises," the name derived from those types of exercises originally created by Dr. Arnold Kegel.

An additional purpose of the bladder control device 1 is to also provide a form of isometric exercise which assists a user in toning and firming the thigh, buttocks, and lower abdominal muscles. The bladder control device 1 also works on the lower-back, which may assist in relieving lower-back pain. The amount of time necessary for toning the targeted muscles largely depends on a user's current physical condition. However, studies and usage feedback has revealed several users reporting improved bladder and bowel control in as little as fourteen days.

After giving birth, a woman's muscles may have lost their tone from being stretched by the birthed child. The bladder control device 1 and method are very effective in helping a woman recover the muscle tone her body had before pregnancy. Also, this usage can solve a mother's leakage problems, in most cases.

BRIEF DESCRIPTION OF THE VIEWS OF THE DRAWINGS AS EXEMPLARY EMBODIMENTS OF THE INVENTIVE CONCEPT

FIG. 1 displays an overall elevation view of the left side of the bladder control device 1, including the furrowed non-slip saddle 5 component of the bladder control device 1.

Figure 2:
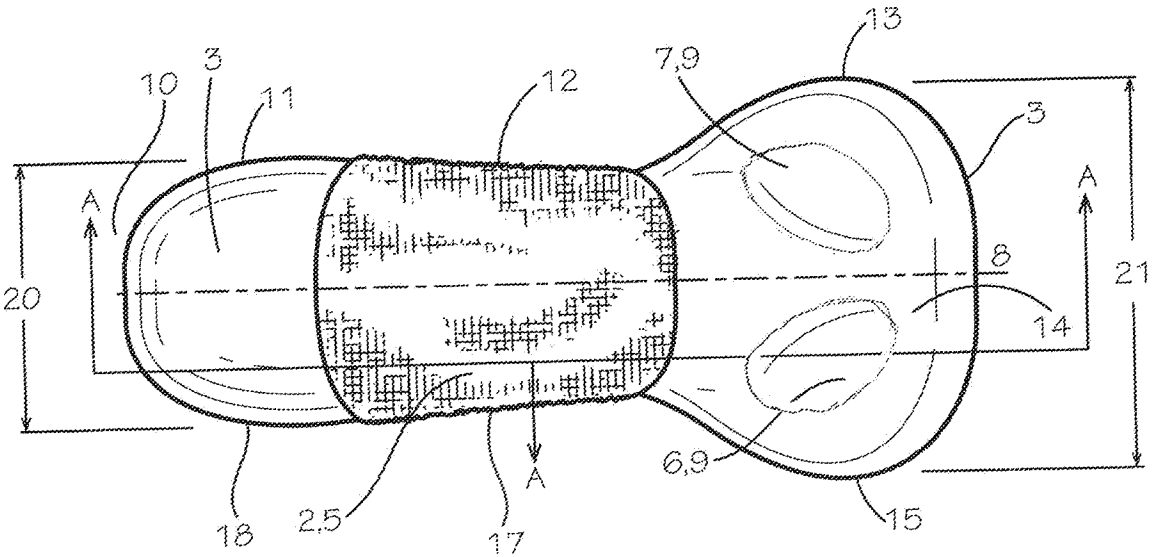

FIG. 2 is a direct planar view looking downward toward the upper exterior surface 9 of the bladder control device 1, further showing the saddle 5, which is permanently attached to the middle portion, or seat 2 of the bladder control device 1.

Figure 2A:
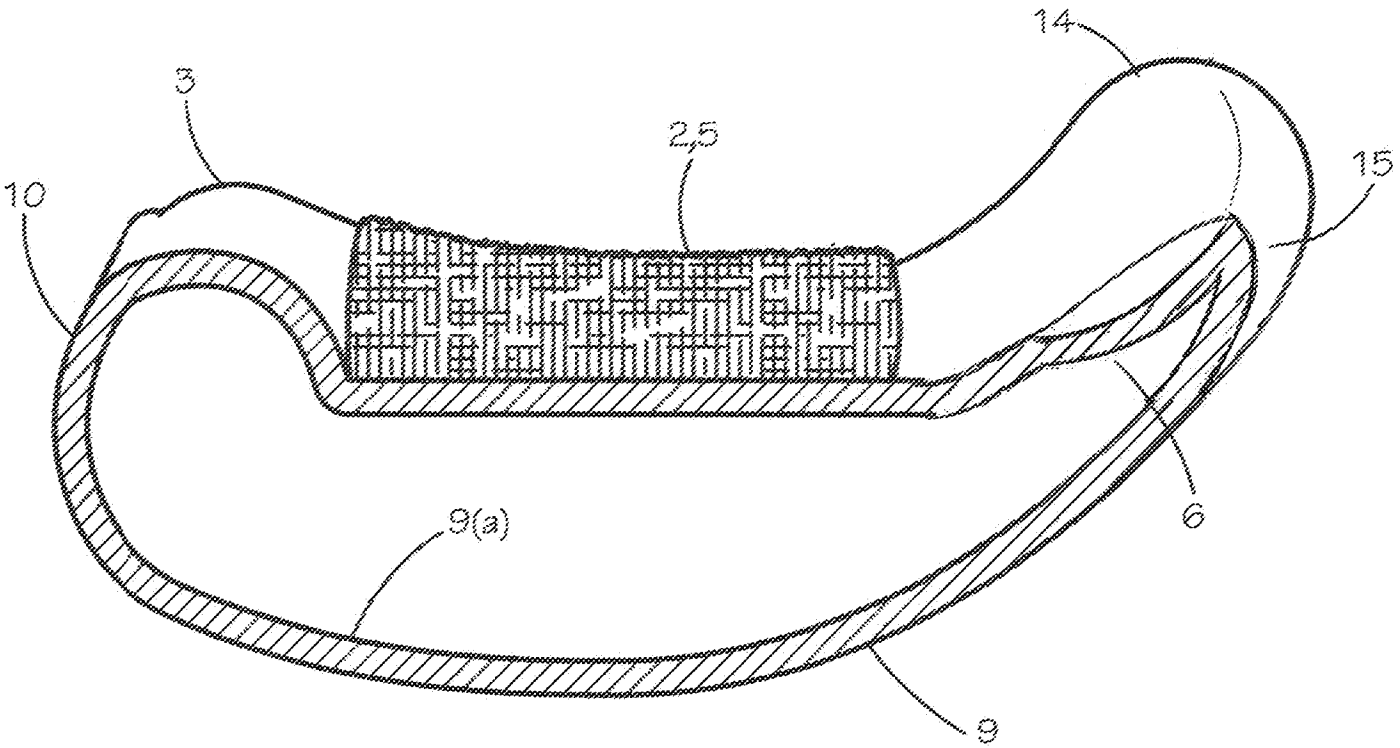

FIG. 2A is a cross-sectional view of the left side of the bladder control device 1, in accordance with the orientation of section line A-A of FIG. 2.

Figure 3:
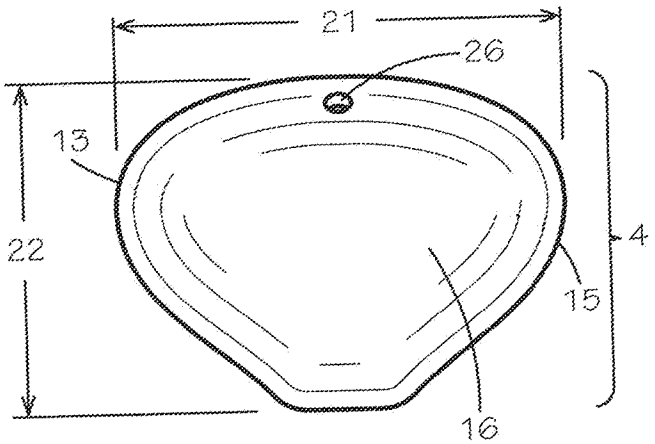

FIG. 3 presents a view of the backstop lower rear end 16 of the backstop segment 4 of the bladder control device 1, as depicted looking forward along the longitudinal axis 8 of the bladder control device 1.

Figure 4:
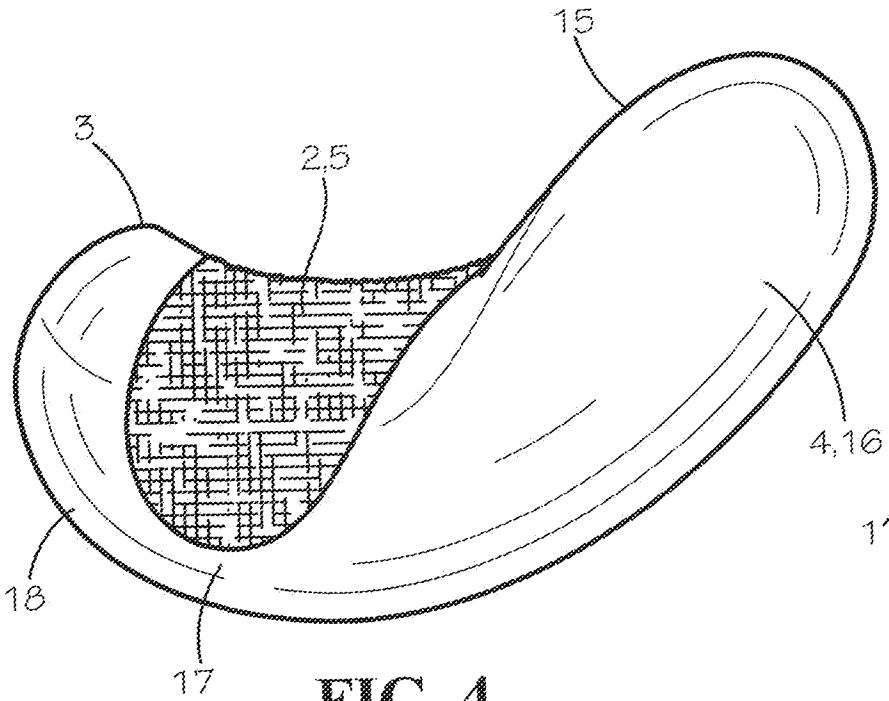

FIG. 4 is a perspective view of the bladder control device 1, as viewed from a position near the area of the backstop segment 4 and looking toward the midsection and the horn 3 of the bladder control device 1.

Figure 5:
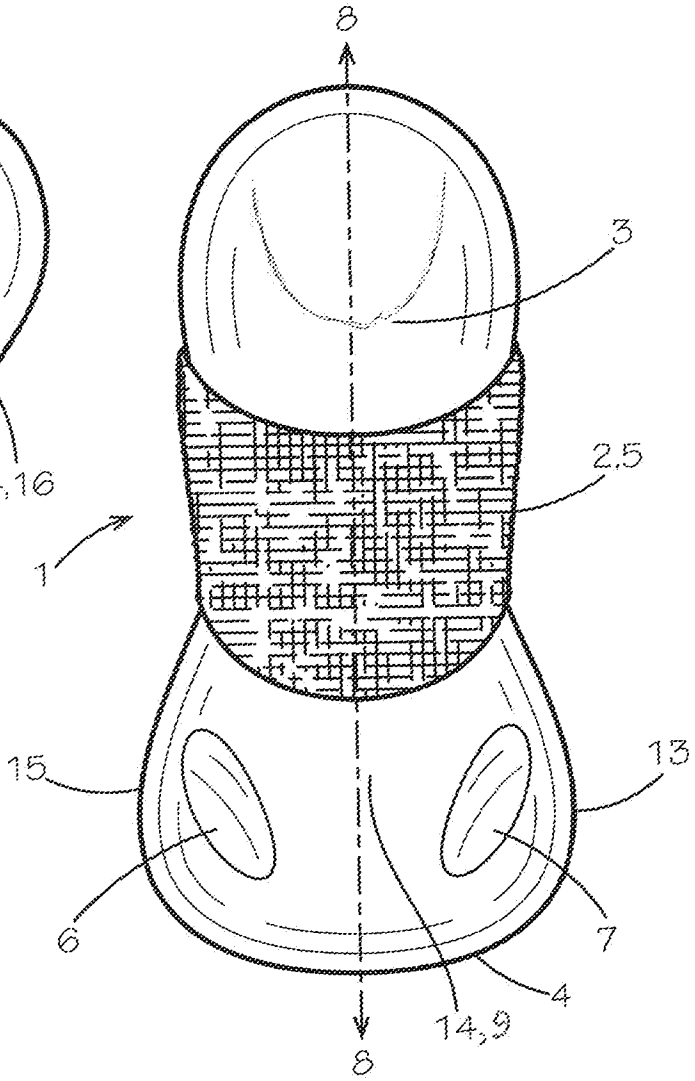

FIG. 5 displays a view of the bladder control device 1, with the device 1 having its longitudinal axis 8 oriented vertically, thereby placing the horn 3 in the upper segment of this view, and the backstop segment 4 in the lower segment of FIG. 5.

| Table of Nomenclature & Part Numbers of Invention |
|---|
| 1. Bladder control device. |
| 2. Seat |
| 3. Horn |
| 4. Backstop segment |
| 5. Saddle |
| 6. Left indentation |
| 7. Right indentation |
| 8. Longitudinal axis |
| 9. Exterior surface |
| 9(a) Interior surface |
| 10. Front end |
| 11. Right front quarter |
| 12. Right center section |
| 13. Backstop right segment |
| 14. Backstop upper rear end |
| 15. Backstop left segment |
| 16. Backstop lower rear end |
| 17. Left center section |
| 18. Left front quarter |
| 19. Rear end |
| 20. Horn diameter |
| 21. Width dimension of backstop |
| 22. Vertical dimension backstop |
| 23. Horn circumference |
| 24. Length of saddle 5 |
| 25. Girth of saddle 5 (from left lower edge circumferentially to the right lower edge) |
| 26. Construction orifice |
| 27. Length of device |

DETAILED DESCRIPTION OF THE INVENTION

The objects, features, and advantages of the inventive concept presented in this application are more readily understood when referring to the accompanying drawings. There is a total of six drawing figures, which show the basic construction, components, and/or methods of use. In the several figures, like reference numbers are used in each figure to correspond to the same component as may be depicted in other figures.

The terminology used herein is for the purpose of describing a particular embodiment only, and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise.

It will be further noted that the terms, "comprises" and/or "comprising," when used in this document, specify the presence of stated features, steps, operations, elements, and/or components, but do not preclude the presence or addition of one or more additional features, steps, operations, elements, components, and/or groups thereof.

The discussion of the present inventive concept will be initiated with FIG. 1, which illustrates a left-side view of the bladder control device 1. By way of introductory information, the bladder control device 1 is a self-enclosed, hollow structure of uniformly smooth, consistent rigid material. Its outer surface consists of a vinyl-like plastic substance. In the preferred embodiment the material used for molding the bladder control device 1 is the rigid form of poly-vinyl chloride. The thickness of the surface of the device 1, from its exterior surface 9 to the interior surface 9(*a*) is, in the preferred embodiment, 0.3 cm. The poly-vinyl chloride material provides an effective amount of resistance in performing the exercises that will strengthen a user's pelvic muscles proximate both the bladder and sphincter. Thus, the bladder control device 1 is effective in treating both urinary incontinence and fecal incontinence.

In referring to FIG. 1, it is to be noted that the bladder control device 1 is constructed within an effective range of dimensions, thereby facilitating its use by individuals of different body size, height, and weight. In the preferred embodiment, the optimal oblong length 27 of the bladder device, as measured along its longitudinal axis 8 and from the horn 3 segment to the backstop segment 4, is 21.0 centimeters (hereinafter, "cm"), as shown in FIG. 1. The vertical dimension 22 of the backstop segment 4 is 10.5 cm. Further, the horizontal length 24 of the saddle 5 is 9.0 cm. The girth 25 of the saddle, as measured from the lowest point of the left side of the saddle 5, circumferentially to the lowest point of the right side of the saddle 5 is 17.0 cm.

The circumference 23 of the horn 3, at its largest profile shown in FIG. 5, is 24.0 cm. The general diameter 20 of the horn 3, measured across the longitudinal axis 8, shown in FIG. 2, is 7.0 cm. In referring to FIG. 3, it is seen that the width 21 of the backstop lower rear end 16 is 11.0 cm. With the bladder control device 1 resting on its underside, the vertical dimension 22 of the backstop lower rear end 16 is 10.5 cm. The depressed seat 2 section of the bladder control device 1 has an elliptical curvature which transitions into the backstop upper rear end 14 of the device 1. The thickness of the saddle 5, in the preferred embodiment is 0.2 cm.

In the preferred embodiment, the saddle 5 dimensions, as shown in FIG. 1, comprise a front-to-back length 24 of 9.0 cm, along the upper exterior surface 9 of the saddle 5. The girth 25 of the saddle 5, as measured circumferentially from the left center bottom section 17 to the right center bottom section 12, is 24.0 cm. In order to accommodate larger-sized individuals, the foregoing measurements may be increased in relative percentages, from 10.0 to 20.0%.

The bladder control device 1 is a self-enclosed, hollow structure. The exterior surface 9 is smoothly finished, and further, the exterior surface material is consistent throughout the entire structure of the bladder control device 1. The exterior surface 9 is inflexible, smooth, and firm to the touch of human skin, except for the saddle 5, which is of a furrowed texture so as to inherently provide a non-slip grasping surface for the thigh muscles. Also shown, in FIG. 2A of this disclosure is the inner surface 9(*a*) of the bladder control device 1.

To facilitate the effectiveness of the bladder control device 1, the saddle 5 is bonded or cemented to the depressed seat 2 segment of the exterior surface 9. The saddle 5 is constructed of a non-slip, furrowed material of uneven texture. In the preferred embodiment, the saddle 5 has miniaturized longitudinal and lateral furrows fabricated into the surface of the saddle 5, giving it an uneven texture. The saddle 5 is thus more effectively grasped by the inner thigh muscles, (whether by direct skin contact or through the texture of clothing that may be worn by the user) when performing Kegel exercises with the bladder control device 1.

In FIG. 2 there is presented a plan view looking downward toward the upper exterior surface 9 of the bladder control device 1, further showing the saddle 5 attached to the middle portion, or depressed seat 2 of the bladder control device 1. When engaging in use of the bladder control device 1, a user positions the right center section 12 of the bladder control device 1 against his/her right upper thigh, while simultaneously placing the left center section 17 of the bladder control device 1 against the left upper thigh. This automatically orients the saddle 5 and depressed seat 2 immediately under the user's crotch area.

At this point, the backstop segment 4 of the bladder control device 1 comfortably rests proximate the vicinity of the user's inner buttocks and rectum area. This arrangement further places the horn 3 of the bladder control device 1 proximate the frontal part of the pelvic floor. Upon the user squeezing his/her upper thigh muscles, this action naturally has the resulting effect of also strengthening the pelvic floor muscles.

The human pelvic floor lies at the base of the pelvis and functions by supporting pelvic organs, maintaining sphincter tone, contributing to sexual function, helping support posture, and aiding in blood and lymphatic flow.

FIG. 2A is a cross-sectional view of the left center section 17 and the backstop left segment 15 of the bladder control device 1, which is shown to comprise a hollow body. To be particularly noted in FIG. 2A is the position and profile of the left indentation 6 existing in the upper surface of the backstop segment 4. The illustration in FIG. 2A corresponds to the view resulting from looking in the direction and orientation of section line A-A of FIG. 2. The bladder control device 1 is also fabricated with an identical right indentation 7 existing on the upper surface of the backstop segment 4, just above the backstop right segment 13 of the bladder control device 1. Both the left indentation 6 and right indentation 7 are symmetrically spaced, and serve the purpose of providing support for the crotch area of a user.

In referring to FIG. 3, there is illustrated a view of the backstop lower rear end 16 of the backstop segment 4. The view of FIG. 3 is depicted looking along the longitudinal axis 8 of the bladder control device 1 of FIG. 2. As mentioned earlier, the exterior width 21 of the backstop segment 4, being the backstop rear end 16, is 11.0 cm in the preferred embodiment. The backstop segment 4 assists a user in estimating and maintaining an effective orientation of the bladder control device 1 against the crotch and inner buttocks of the user, proximate the exterior of the pelvic floor while performing designated exercises. FIG. 3 also displays a construction orifice 26, a result of the use of machination and positioning of the body of the bladder control device in a mold during manufacture.

FIG. 4 presents a perspective view of the bladder control device 1, as seen looking toward the left rear section 15 of the device backstop segment 4 and lower rear end 16. FIG. 4 provides a more revealing impression of the overall contour and orientation of the bladder control device 1.

In referring to FIG. 4, a user, when engaging in use of the bladder control device 1, positions the left center section 17 and right center section 12 (out of view) of the bladder control device 1 against his/her left upper thigh and right upper thigh, respectively. The left center section 17 and right center section 12, collectively are referred to as the midsection of the device 1. This orientation places the depressed seat 2 and saddle 5 immediately under the user's crotch area. The backstop segment 4, particularly the backstop upper rear end 14, then comfortably rests proximate the vicinity of the user's inner buttocks and rectum area. Further, the horn 3 of the bladder control device 1 is oriented close to the user's thighs and proximate the frontal part of the user's pelvic floor muscles.

FIG. 5 displays a view of the bladder control device 1, with the device 1 having its longitudinal axis 8 oriented vertically, thereby placing the horn 3 in the upper segment of this view and the backstop segment 4 in the lower portion of FIG. 5. Further shown in FIG. 5, in descending order, are the saddle 5 which is permanently attached to the seat 5 (the seat, therefore, is not in view) and the left indentation 6 and right indentation 7, Both indentations 6, 7, are slightly depressed, and symmetrically spaced, below the outer surface 9 of the upper rear end 14 of the backstop segment 4 of the bladder control device 1. FIG. 5, thusly, provides supplemental information and familiarity with the overall contour and structure of the bladder control device 1.

The method which should be employed in conjunction with the bladder control device 1 is simple and effective. It consists of three exercises that take approximately 10 minutes to perform. This exercise routine is performed twice per day to get the user's muscles back into normal condition and solve episodic bladder or bowel incontinence problems. The exercises are all performed in a standing position and present no risk of injury since the user remains stationary while performing the exercises. The structure of the seat 2 and the accompanying furrowed texture of the saddle 5 provide substantial gripping assistance to a user while flexing the associated muscles in performing the exercise routine.

A significant benefit in using the method of use of the bladder control device 1 is that there is no surgery required. A user gains the benefits and health gains with only 10 minute sessions twice a day. This will result in an improvement of bladder and bowel control. The use of the bladder control device 1 is non-invasive and nothing needs to be inserted into a user's body.

The bladder control device 1 and combined method help tone specific muscles related to childbirth, and can be very beneficial to the expectant mother as well as the mother who has given birth. During pregnancy, a simple laugh, cough, or sneeze can cause urinary leakage. Since the affected muscle surrounds the urinary tract, performing exercises with the bladder control device 1 can help prevent leakage problems for mothers. Further, good PC muscle tone contributes to a smoother delivery by increasing pushing power. It can also decrease delivery time which minimizes painful muscle damage and reduces recovery time.

While preferred embodiments of the present inventive method have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, as described by the scope of the claims presented herein.

What is claimed is:

1. A device for eliminating episodic occurrences of urinary and bowel incontinence in both men and women, the device comprising a generally crescent-shaped, oblong, hollow body, having a uniformly smooth exterior surface, a rounded front horn, a top surface having a depressed seat, lateral curvature forming a left-side surface, a left center section, a right center section, a right-side surface, and a rear backstop segment, an upper rear surface of the backstop rising upward from the seat in a gradual elliptical shape, and culminating in a widened rear end; the backstop further having, symmetrically spaced on its upper rear end, a left indentation and a right indentation; and a saddle permanently affixed to the seat, the saddle extending over the left side, center sections, and the right side of the device; the saddle further comprising a layer of material having a furrowed, uneven texture, being 0.2 cm thick, and inherently providing non-slip, gripping assistance to a user, thereby enabling the user to effectively perform exercises with the device while in a stationary, standing position.

2. The device of claim 1, wherein the hollow body is uniformly constructed of polyvinyl chloride.

3. The device of claim 1, having, in its preferred embodiment, the following dimensions: overall device length 20.0 cm; length of seat 9.0 cm; girth of the seat, 17.0 cm; girth of the horn 25.0 cm; general diameter of the horn across the longitudinal axis, 7.0 cm; width of the backstop 11.0 cm; vertical height of the backstop being 9.0 cm; and thickness of the exterior surface being 0.3 cm, thereby enabling the user to effectively use the device by performing exercises while in a stationary, standing position.

4. The device of claim 1, further, having the following range of dimensions: overall device length 20.0 cm to 25.0 cm, length of seat 9.0 cm, to 11.0 cm, girth of the horn 25.0 cm to 30.0 cm; diameter of the horn across the longitudinal axis, 7.0 cm to 8.5 cm, the girth of the saddle being 24.0 cm to 29 cm, the width of the backstop 11.0 cm to 13.0 cm, and vertical length of the backstop being 9.0 cm to 11.0 cm, thereby enabling the user to effectively perform exercises with the device, while the user stands in a stationary position.

5. A method for eliminating urinary and bowel incontinence in both men and women, by means of the use of a device external to a user's body, the method comprising the steps of:

a) providing a device comprising a generally crescent-shaped, hollow body approximately 20.0 centimeters in length, having a uniformly smooth exterior surface, a rounded front horn, a top surface having a slightly depressed seat, lateral curvature forming a left side surface, a left center section, a right side surface, a right center section, and a rear backstop; the upper surface of the backstop rising upward from the rear of the depressed seat in a gradual elliptical curve and culminating in a widened rear end, the backstop further having, symmetrically spaced on its upper surface, a left indentation and a right indentation;

b) permanently affixing a saddle to the area of the depressed seat, the saddle extending over the left side, the center section, and the right side of the device and further, the saddle comprising a layer of material having a furrowed, uneven texture which material inherently provides non-slip, gripping assist to a user; thereby, c) enabling a user to perform exercises with the device while the user is in a stationary, standing posture, by positioning the right center section of the bladder control device against the user's right upper thigh, while simultaneously placing the left center section of the bladder control device against the user's left upper thigh, thus orienting the furrowed, uneven textured saddle and depressed seat immediately under the user's pelvic area, whereupon the user flexes the upper thigh muscles and pelvic floor muscles against the device for a set time period.

6. The method of claim 5, wherein the hollow body is uniformly constructed of polyvinyl chloride.

7. The method of claim 5, having, in its preferred embodiment, the following dimensions: overall device length 20.0 cm; length of seat 9.0 cm; girth of the seat, 17.0 cm; girth of the horn 25.0 cm; general diameter of the horn across the longitudinal axis, 7.0 cm; width of the backstop 11.0 cm; vertical height of the backstop being 9.0 cm; and the thickness of the surface being 0.3 cm.

8. The method of claim 5, further, having the following range of dimensions: overall device length 20.0 cm to 25.0 cm, length of seat 9.0 cm, to 11.0 cm, girth of the horn 25.0 cm to 30.0 cm, the diameter of the horn across the longitudinal axis, 7.0 cm to 8.5 cm, the girth of the saddle being 24.0 cm to 29 cm, the width of the backstop 11.0 cm to 13.0 cm, and vertical length of the backstop being 9.0 cm to 11.0 cm.

9. An improvement to a device of the type having generally, a crescent-shaped, oblong, hollow body, with a uniformly smooth exterior surface, and/utilized as a physically self-actuated means to eliminate episodic occurrences of urinary and bowel incontinence by a user performing contractions of the pelvic floor muscles against the exterior surface of the device, wherein the improvement comprises:

(a) permanently affixing a saddle structure to extend over a left side, center section, and over a right side of the device, (b) the saddle further comprising a layer of material having a furrowed, uneven texture, being 0.2 cm thick, and (c) having an overall girth sufficient to encompass a midsection of the device, (d) the saddle structure thereby providing non-slip, gripping assistance to a user.

* * * * *